US010408542B2

(12) United States Patent
Heitmann et al.

(10) Patent No.: US 10,408,542 B2
(45) Date of Patent: Sep. 10, 2019

(54) HEAT EXCHANGE DEVICE FOR COOLING SYNTHETIC GAS AND METHOD OF ASSEMBLY THEREOF

(71) Applicant: Air Products and Chemicals, Inc., Allentown, PA (US)

(72) Inventors: Alfons Heitmann, Gummersbach (DE); Joachim Papendick, Hamburg (DE); Eckhard Friese, Gummersbach (DE); Gerhard Johan Van Elburg, Amsterdam (NL); Unai Jauregi, Amsterdam (NL); Mohammad Behzad, Amsterdam (NL)

(73) Assignee: Air Products and Chemicals, Inc., Allentown, PA (US)

( * ) Notice: Subject to any disclaimer, the term of this patent is extended or adjusted under 35 U.S.C. 154(b) by 240 days.

(21) Appl. No.: 15/310,511

(22) PCT Filed: May 7, 2015

(86) PCT No.: PCT/EP2015/060032
§ 371 (c)(1),
(2) Date: Nov. 11, 2016

(87) PCT Pub. No.: WO2015/173103
PCT Pub. Date: Nov. 19, 2015

(65) Prior Publication Data

US 2017/0082375 A1 Mar. 23, 2017

(30) Foreign Application Priority Data

May 13, 2014 (EP) ..... 14168016

(51) Int. Cl.

| | |
|---|---|
| ***F28D 7/16*** | (2006.01) |
| ***C10J 3/72*** | (2006.01) |
| ***F28F 9/22*** | (2006.01) |
| ***F28F 1/22*** | (2006.01) |
| ***F28F 9/013*** | (2006.01) |
| ***F28F 9/02*** | (2006.01) |
| ***F28F 13/06*** | (2006.01) |

(52) U.S. Cl.
CPC ..... *F28D 7/1669* (2013.01); *C10J 3/72* (2013.01); *F28F 1/22* (2013.01); *F28F 9/0131* (2013.01);
(Continued)

(58) Field of Classification Search
CPC .. F28F 13/06; F28F 9/0265; F28F 9/22; F28F 1/10; F28F 1/40; F28F 13/02;
(Continued)

(56) References Cited

U.S. PATENT DOCUMENTS 3,732,850 A * 5/1973 Coley ..... F22B 9/04 122/155.4
3,841,301 A * 10/1974 Chamberlain ..... F24H 3/105 126/110 R (Continued)

FOREIGN PATENT DOCUMENTS

DE 4324586 11/1994
EP 0006795 1/1980

(Continued)

*Primary Examiner* — Imran Akram
(74) *Attorney, Agent, or Firm* — Bryan C. Hoke, Jr.

(57) ABSTRACT

The invention relates to a heat exchange device comprising a channel wall defining a flow channel with an inlet for receiving a gas flow. The device further comprises one or more heat exchange surfaces positioned inside the flow channel creating different parallel flow paths for the gas flow through the flow channel, at least one of the heat exchange surfaces embedding one or more flow paths for a fluid heat exchange medium. The one or more deflection elements are positioned inside the flow channel and are attached to the channel wall to deflect the gas flow away from the channel wall.

8 Claims, 6 Drawing Sheets

Figure 1:
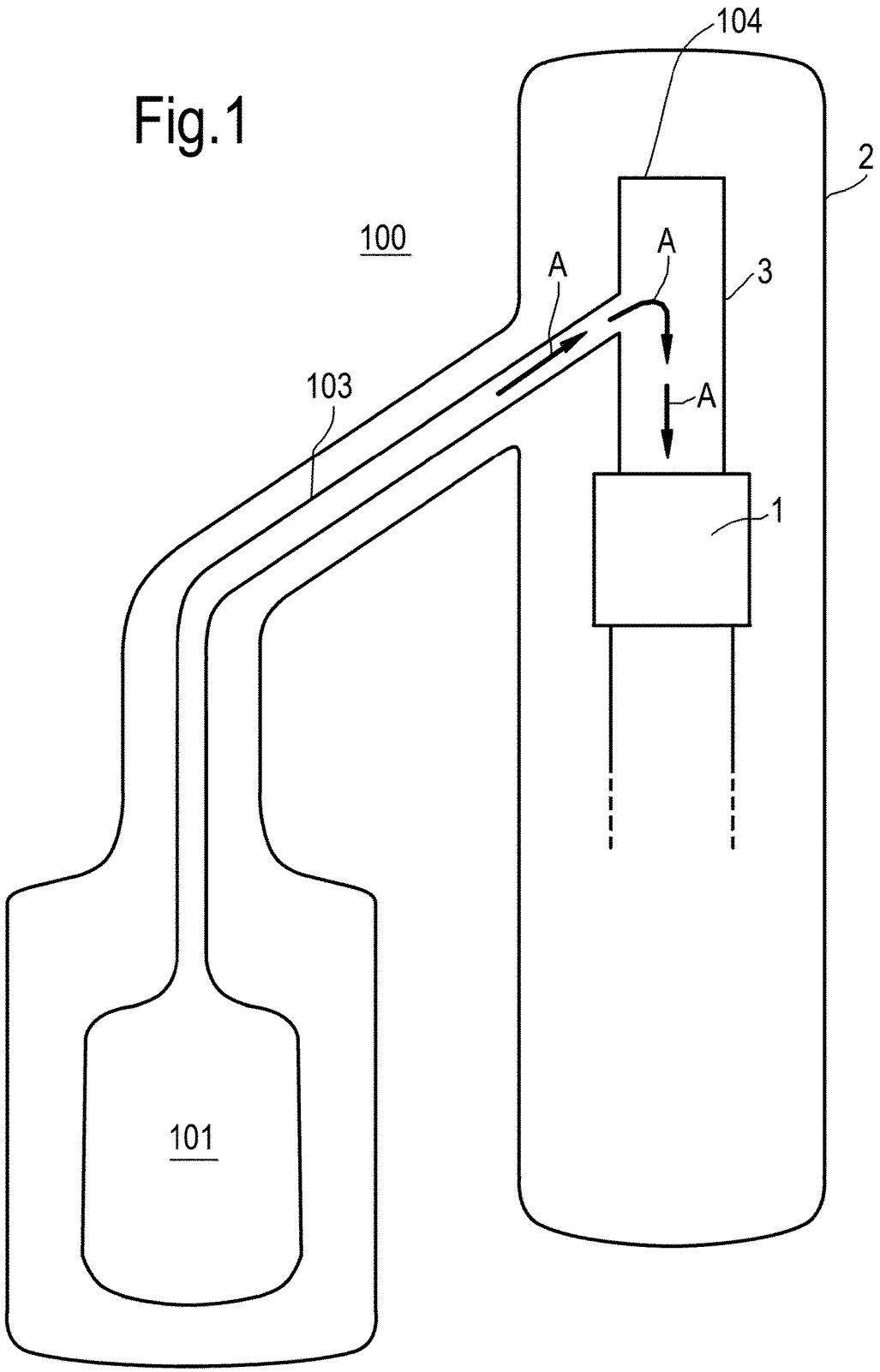

(52) U.S. Cl.
CPC ..... *F28F 9/0138* (2013.01); *F28F 9/0265* (2013.01); *F28F 9/22* (2013.01); *F28F 13/06* (2013.01); *C10J 2300/1846* (2013.01); *F28F 2009/228* (2013.01); *F28F 2230/00* (2013.01); *F28F 2265/26* (2013.01)

(58) Field of Classification Search
CPC ..... F28F 2215/00; F28F 2215/02; F28F 2215/04; F28F 2215/06; F28F 2215/08; F28F 2215/10; F28F 2215/12; F28F 2215/14
See application file for complete search history.

(56) References Cited

U.S. PATENT DOCUMENTS 5,482,110 A 1/1996 Hartermann et al.
2005/0058535 A1* 3/2005 Meshenky ..... F02B 29/0412 415/121.3
2012/0031594 A1* 2/2012 Smit ..... F24H 1/40 165/148
2012/0125567 A1* 5/2012 Von Kossakglowczewski ..... F28D 7/0041 165/67
2014/0238006 A1* 8/2014 Iwasaki ..... F28F 3/027 60/320

FOREIGN PATENT DOCUMENTS

JP 1982S57-036477 U 2/1982
JP 1984S59-147989 A 8/1984
JP 1985S60-196174 U 10/1985
JP 2013-127362 A 12/2009
JP 2012-533042 A 5/2012
JP 2013-536931 A 9/2013
NL 7018263 6/1971
WO WO2011003889 1/2011
WO WO2011089140 7/2011
WO WO2012028550 3/2012
WO WO-2013058267 A1 * 4/2013 ..... F28F 3/027

* cited by examiner 104
2
100
A
A
3
103
A
1
101

HEAT EXCHANGE DEVICE FOR COOLING SYNTHETIC GAS AND METHOD OF ASSEMBLY THEREOF

CROSS-REFERENCE TO RELATED APPLICATIONS

The present application is a National Stage (§ 371) application of PCT/EP2015/060032, filed May 7, 2015, which claims the benefit of European Application No. 14168016.5, filed May 13, 2014, which is incorporated herein by reference in its entirety.

TECHNICAL FIELD

The present invention relates to a heat exchange device for cooling synthetic gas. The invention also relates to a plant for the production of synthetic gas and a method of assembling such a heat exchange device.

STATE OF THE ART

In gasification processes for the production of synthetic gas, also referred to as syngas, carbonaceous feedstock is partially oxidised in a gasification reactor. The carbonaceous feedstock may be coal, heavy petroleum residues and/or biomass.

Initially, the produced syngas typically has a temperature of 1300-1600° C. When the syngas leaves the gasification reactor the hot syngas may be quenched to temperatures between 700-1000° C. and is then transported to a cooling section or syngas cooler comprising one or more heat exchangers for further cooling of the syngas.

Such syngas coolers are known and are for instance described in WO2011/089140, WO2011/003889 and WO2012/028550.

Syngas coolers typically comprise a channel wall defining a flow channel for the syngas. The channel wall is formed by a membrane wall, comprising parallel tubular pipe lines. The membrane wall is usually cylindrical shaped. The syngas typically flows in a substantial downward direction through the flow channel The parallel tubular pipe lines run parallel to the flow direction of the syngas, i.e. substantially vertical.

The tubular pipe lines of the membrane wall are connected together to form a gastight wall. The tubular pipe lines may directly be connected together, or via fins, resulting in a so-called tube-fin-tube arrangement. Connections may be created by welding. A cooling medium, such as water flows through the tubular pipe lines of the channel wall.

Inside the channel wall a plurality of nested heat exchange surfaces are positioned within the flow channel, the fluid heat exchange surfaces embedding one or more flow paths for a fluid heat exchange medium, such as steam, and comprising supply and discharge connections for the supply and discharge of the fluid heat exchange medium.

The nested heat exchange surfaces can have any suitable shape, but are typically cylindrical. The nested heat exchange surfaces have different dimensions (in a direction perpendicular to the flow direction) such that they can be positioned in a coaxial orientation, wherein smaller heat exchange surfaces are positioned inside larger heat exchange surfaces.

The heat exchange surfaces may be formed by helically shaped conduits, which are connected to the supply and discharge connections for the supply and discharge of the fluid heat exchange medium.

Different flow paths for the syngas are created in between neighbouring nested heat exchange surfaces and one outer flow path is created in between the outer heat exchange channel and the membrane wall. The flow path inside the inner most heat exchange surface may be closed or closeable.

Further provided is a support structure for supporting the nested heat exchange surfaces within the channel formed by the channel wall. The support structure may comprise a plurality of arms extending from a central crossing to the channel wall.

The heat exchange surfaces can rest on the support structure, or the heat exchange surfaces can hang down from the support structure. The one or more heat exchange surfaces can be connected to the support structure, e.g., by welding joints. The support structure can be joined to the channel wall, or to a load bearing structure within the channel wall.

The cooling medium flowing through the membrane wall of the channel wall typically originates from a different supply than the fluid heat exchange medium flowing through the nested heat exchange surfaces. The cooling medium for the membrane wall may be liquid water close below its boiling point, for instance at a temperature of 270° C. at a pressure of 68 bar(g), where the fluid heat exchange medium for the nested heat exchange surfaces may be steam which enters the heat exchange surfaces as so called saturated steam approximately 270° C. and leaves the heat exchange surfaces as so called superheated steam at approximately 400° C.

When the syngas cooler is part of a plant in which the fluid heat exchange medium exiting the nested heat exchange surfaces is to be used for further purposes, it may be necessary to influence and/or guarantee the temperature of the fluid heat exchange medium leaving the heat exchange surfaces.

SHORT DESCRIPTION

It is an object to provide an improved syngas cooler in which the heat transfer from the syngas to the cooling medium flowing through the membrane wall and the heat transfer from the syngas to the fluid heat exchange medium flowing through the nested heat exchange surfaces can be controlled more accurately. It is a further object to adapt syngas coolers to control the temperature of the fluid heat exchange medium leaving the heat exchange surfaces more accurately.

According to an aspect there is provided a heat exchange device for cooling synthetic gas, the heat exchange device comprising:

- a channel wall defining a flow channel with an inlet for receiving a gas flow;
- one or more heat exchange surfaces positioned inside the flow channel creating different parallel flow paths for the gas flow through the flow channel, at least one of the heat exchange surfaces embedding one or more flow paths for a fluid heat exchange medium;
- one or more deflection elements positioned inside the flow channel and attached to the channel wall to deflect the gas flow away from the channel wall.

The heat exchange device is in particular a heat exchange device suitable for receiving and cooling synthetic gas having a temperature in the range of 1000-700° C.

The different flow paths comprise one or more flow paths between different heat exchange surfaces and a flow path along the channel wall.

The deflection elements protrude inwardly from the channel wall and cause the gas flow to deflect away from the channel wall, thereby reducing the flow through the flow path along the channel wall. The flow velocity and mass flow through the other flow paths is increased, thereby increasing the heat exchange between the gas flow and the heat exchange surfaces and the fluid heat exchange medium, typically steam, flowing therethrough. The heat exchange between the gas flow and the channel wall is reduced. The outlet temperature of the heat exchange medium exiting the heat exchange surfaces will therefore be higher. The deflection elements can be used to influence and optimize the outlet temperature of the fluid heat exchange medium. The deflection elements may be removable connected to the channel wall. By removing or adding deflection elements, the outlet temperature of the fluid heat exchange medium can be adapted in a certain range to meet certain temperature requirements.

The gas is a synthetic gas or syngas which is to be cooled by the heat exchange device.

The heat exchange surfaces may comprise supply and discharge connections for the supply and discharge of the fluid heat exchange medium.

The deflection elements may be embodied in any suitable manner, for instance as deflection plates.

According to an embodiment the channel wall is a membrane wall, comprising a plurality of pipe lines forming one or more flow paths for a cooling medium.

According to this embodiment, the deflection elements cause the gas flow to deflect away from the membrane wall, thus reducing the heat exchange between the gas flow and the cooling medium and increasing the heat exchange between the gas flow and the fluid heat exchange medium in the heat exchange surfaces.

The plurality of pipe lines may be directly connected to each other or may be interconnected by fins. In the latter case, the deflection elements may be attached to the fins. The fins can be used in an easy and reliable manner to attach the deflection elements to.

The deflection elements can further be attached to the outer heat exchange surface. However, this may cause problems due to differences in heat expansion coefficients between the channel wall and the heat exchange surface. Therefore, the deflection elements may be positioned not to be in direct contact with the heat exchange surfaces.

According to an embodiment the one or more heat exchange surfaces are coaxially nested heat exchange surfaces of a closed geometry.

The closed geometry may have any suitable shape, such as triangular or square, but preferably the closed geometry is circular, the nested heat exchange surfaces thus having a cylindrical geometry, as is for instance described in WO2011/003889 and U.S. Pat. No. 5,482,110. The heat exchange surfaces can be coaxially arranged or nested within the channel wall, which will typically be cylindrical. Optionally, the support structure can support a series of two or more bundles of nested heat exchange surfaces.

The heat exchange surfaces can be assembled as a plurality of nested heat exchange surfaces of a closed geometry whereby inner heat exchange surfaces have a greater constructive height than the adjacent outer heat exchange surface so that each heat exchange surface can be cleaned by a rapping device (heating surface cleaning device) from the exterior without the need for penetrating any other heat exchange surfaces. The deflection elements may be positioned inside the flow path between the channel wall and the outer heat exchange surface to close or at least partially close this flow path, preferably at the entrance of this flow path. However, this would create slag and fly-ash accumulation in the space between the channel wall and the outer heat exchange surface.

According to an embodiment the one or more deflection elements are positioned upstream of the heat exchange surfaces.

By positioning the deflection elements upstream of the heat exchange surfaces, the gas flow in between the outer heat exchange surface and the channel wall is minimized without disturbing the gas flow too much. In case the heat exchange device is constructed such that the direction of the gas flow is downward, the deflection elements are positioned above the heat exchange surfaces.

The deflection elements are preferably not connected to the heat exchange surfaces which are positioned inside the flow channel. The deflection elements may be positioned to leave a gap "d" (as will be described in more detail below with reference to FIG. 4*c*) between the upper edge or upper tube of the outer heat exchange surface and the deflection element. The gap may be 2-10 mm, for instance 3-5 mm The gap may measured in the direction of the central body axis R. The gap may also be defined as the shortest distance between the deflection element and the outer heat exchange surface.

This prevents problems which could result from differences in heat expansion coefficients between the channel wall and the heat exchange surface.

The size of the gap can be adapted and optimized to specific requirements.

According to an embodiment the deflection elements comprise a deflection surface which is at an angle ($\beta$) with respect to the channel wall.

The deflection surface may be formed by a baffle plate.

The deflection surface protrudes from the channel wall into the flow channel at an angle $\beta$, wherein angle $\beta$ is the angle between the main direction of the gas flow or central body axis R of the channel wall in the downstream direction and the direction in which the deflection surface extends from the channel wall. Angle $\beta$ may be in the range $10° \leq \beta \leq 45°$, preferably in the range $15° \leq \beta \leq 25°$. Such a deflection surface provides a smooth deflection of the gas flow.

According to an embodiment the individual deflection elements extend over an angle $\alpha$ along the inner perimeter of the channel wall, the angle being in the range $10° \leq \alpha \leq 45°$, preferably in the range $10° \leq \alpha \leq 20°$.

By providing deflection elements that extend over an angle in the indicated range, the deflection elements remain relatively small, making installation and removal relatively easy. Also, this makes it possible to influence the heat transfer between the gas flow and the channel wall relatively accurately by applying deflection elements over a limited range of the inner perimeter. For instance, 6 deflection elements each covering 30° can be applied, thereby extending over half the inner perimeter of the channel wall. If the heat transfer between the gas flow and the channel wall is considered too high, one or more additional deflection elements can be added. If the heat transfer between the gas flow and the channel wall is considered too low, one or more deflection elements can be removed.

The deflection elements may be attached to the channel wall by welding on the inside of the channel wall. However, in practice this may be difficult as there is little manoeuvring room for fitting and welding personnel inside the channel wall, in particular due to the support structure from which the heat exchange surfaces hang down from and the discharge or supply lines carrying the fluid heat exchange medium.

According to an embodiment the deflection elements comprise a baffle plate and an anchor element, the baffle plate being connected to the anchor element, the baffle plate being positioned inside the channel wall to deflect the gas flow away from the channel wall and the anchor element extending outwardly from the channel wall through an opening in the channel wall and being attached to the channel wall on the outside of the channel wall.

This embodiment will be described in more detail below with reference to FIG. 5*a*-5*c*. The baffle plate comprises the deflection surface.

This allows the deflection element to be attached, preferably by welding, from the outside of the channel wall. There is thus no need for personnel to enter the channel wall to perform welding operations or the like. The deflection elements still need to be positioned and removed via the inside of the channel wall, but attaching and detaching is done from the outside.

The deflection element may be attached to the outside of the channel wall by using one or more plates (referred to as pad or sealing plate), the one or more plates having openings to accommodate the anchor element. The plates are positioned against the outside of the channel wall. In case more than one plate is used, the plates are stacked against the outside of the channel wall.

There may be a tight fit between the opening in the channel wall and the anchor element. Alternatively, the opening in the channel wall has larger dimensions than the anchoring element to allow positioning of the deflection element at a desired position relative to the channel wall. The outer plate (pad or sealing plate) of the one or more plates may provide a tight fit between the anchor element and the opening in the outer plate. The term tight fit is used to indicate a fit that can be closed in a gastight manner by welding. A tight fit includes a gap in the range of 1-2 mm According to an embodiment a gap (d2) is present between the baffle plate and the channel wall. This gap is shown in FIG. 5*c* and is preferably in the range 1 to 5 mm The gap may be present between the most upstream edge of the baffle plate and the channel wall to overcome differences in thermal expansion between the baffle plate and the channel wall.

According to a further aspect there is provided a plant for the production of synthetic gas, wherein the plant comprises at least one gasification reactor in which carbonaceous feedstock is partially oxidized producing synthetic gas, the gasification reactor comprising a discharge section for produced synthetic gas, the plant further comprising at least one section with a heat exchange device according to any one of the preceding claims, wherein the inlet of the flow channel is in flow communication with the discharge section for produced synthetic gas of the gasification reactor.

In use, the gas flow through the flow channel of the channel wall is thus formed by produced synthetic gas.

In between the gasification reactor and the heat exchange device further hardware may be present, such as quenching means to obtain a first cooling of the syngas. Also, downstream of the heat exchange device further heat exchange device may be present to further cool the gas.

According to an embodiment there is provided a method of assembling a heat exchange device, the method comprising a) providing a channel wall defining a flow channel with an inlet for receiving a gas flow;

b) providing one or more heat exchange surfaces positioned inside the flow channel creating different parallel flow paths for the gas flow through the flow channel, at least one of the heat exchange surfaces embedding one or more flow paths for a fluid heat exchange medium;

c) installing one or more deflection elements inside the flow channel by attachment to the channel wall to deflect the gas flow away from the channel wall.

Action a) may comprise providing a channel wall formed as membrane wall, the membrane wall comprising a plurality of pipe lines forming one or more flow paths for a cooling medium.

Action b) may comprise providing one or more coaxially nested heat exchange surfaces of a closed geometry.

Action c) may comprise attaching the one of more deflection elements by welding.

According to an embodiment the one or more deflection elements comprise a baffle plate and an anchor element, the baffle plate is connected to the anchor element, wherein c) comprises c1) providing an opening in the channel wall, c2) positioning the one or more deflection elements with the baffle plate inside the channel wall and the anchor element protruding through the opening in the channel wall towards the outside of the channel wall, c3) attaching the deflection element to the outside of the channel wall.

Regarding c1), the opening may be created in an existing channel wall or may be created when manufacturing the channel wall.

Regarding c1), the channel wall may be a membrane wall formed by a tube-fin-tube arrangement, wherein the opening is created in a fin. The opening may be dimensioned to create a tightfit with the anchor element.

According to an embodiment the method further comprises:

- determining the temperature of the fluid heat exchange medium exiting the heat exchange surfaces,
- adjusting the number, size, position and/or configuration of the deflection elements.

Determining the temperature may be done by measurement or by simulation.

Depending on the outcome the deflection elements may be adjusted, e.g.

- the number of deflection elements may be increased or decreased,
- the size of the deflection elements may be adjusted, including the length of the deflection surface and/or the angle a along the inner perimeter of the channel wall the deflection element covers,
- the position of the deflection elements may be changed, which is in particular useful in situations wherein the gas flow is not uniformly distributed throughout the flow channel as a result of an asymmetrical condition upstream of the heat exchange device,
- the configuration of the deflection elements may be changed, such as the angle β between the deflection surface and channel wall.

SHORT DESCRIPTION OF THE DRAWINGS

Figure 2:
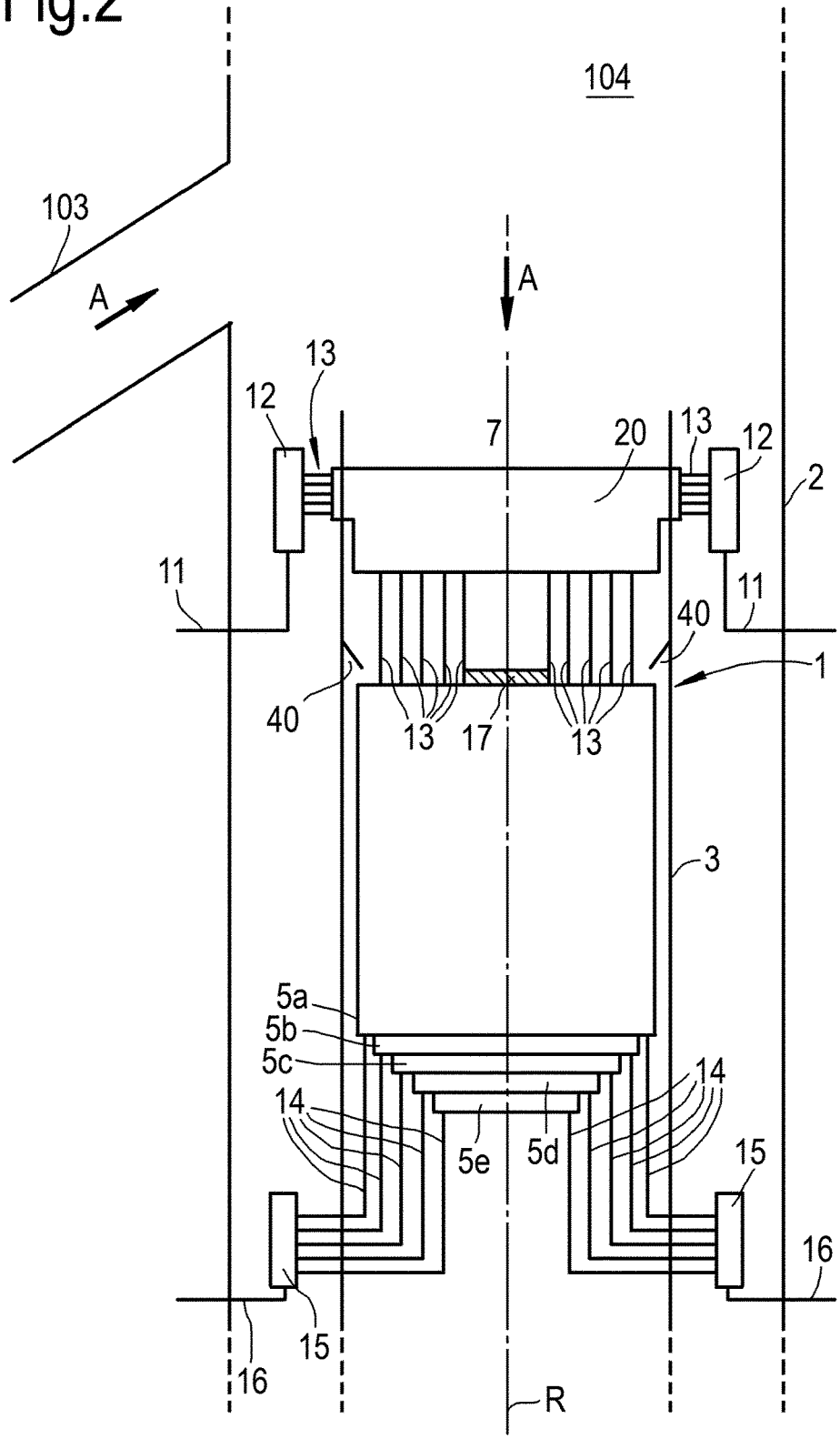
Figure 3A:
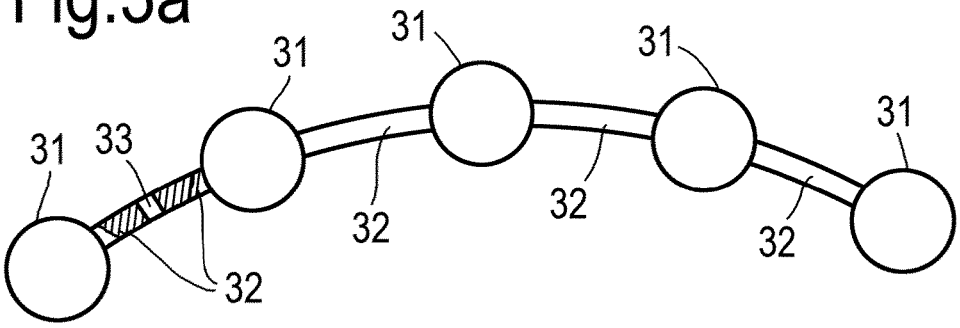
Figure 3B:
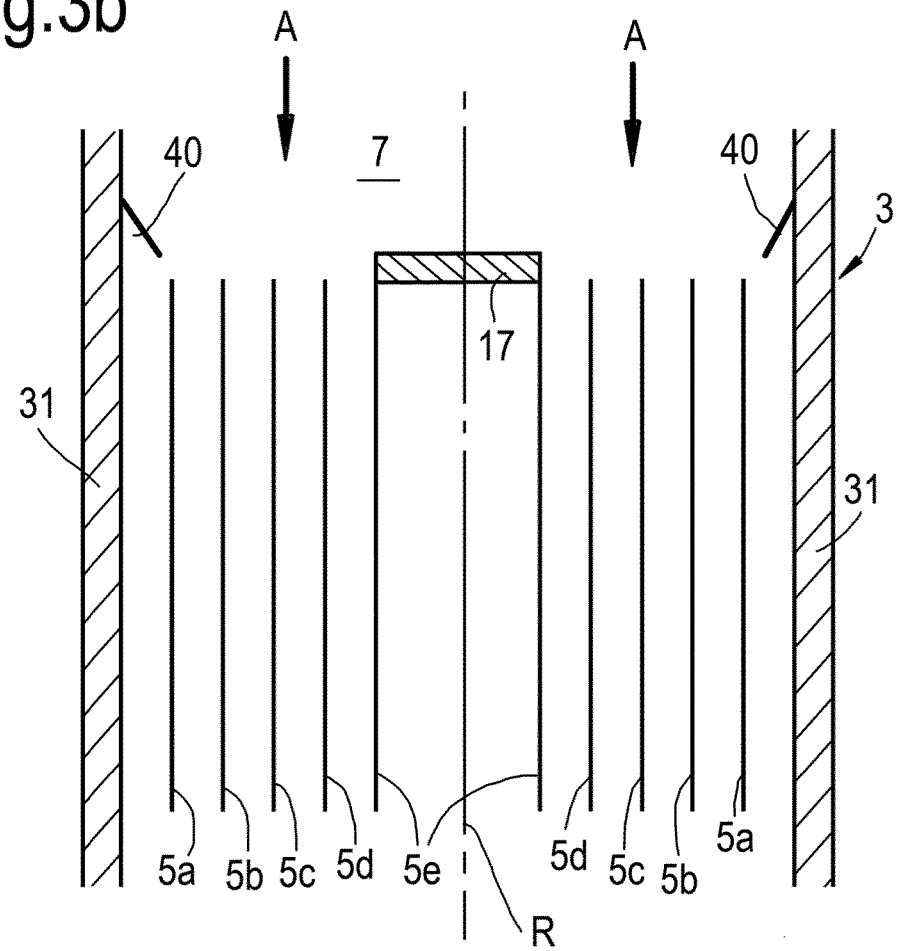
Figure 4A:
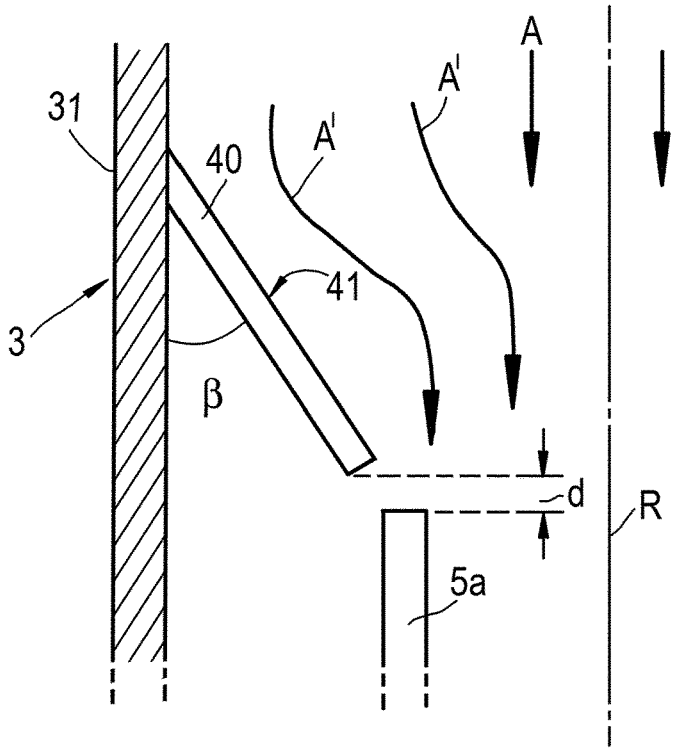
Figure 4B:
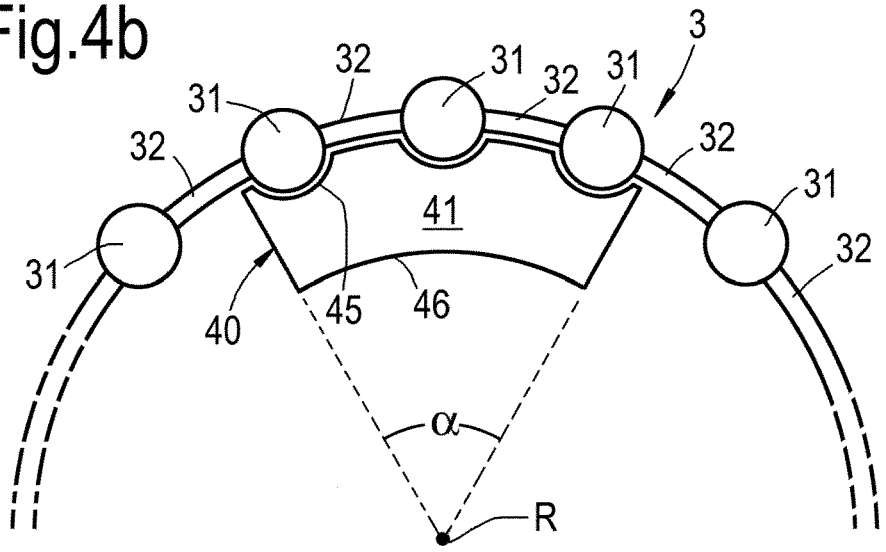
Figure 5A:
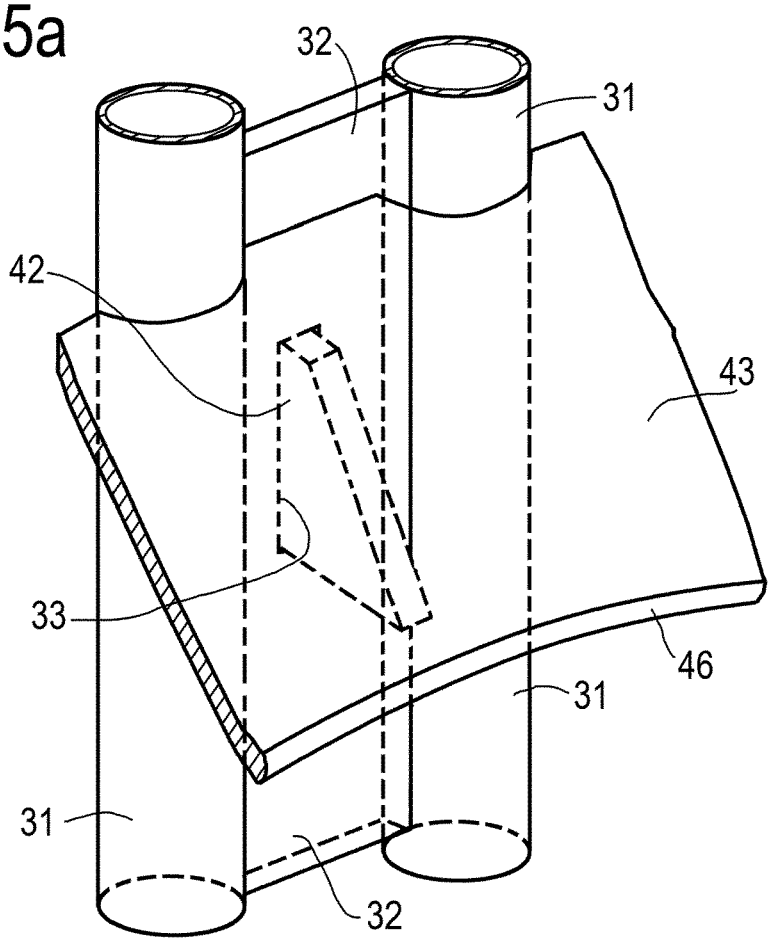
Figure 5B:
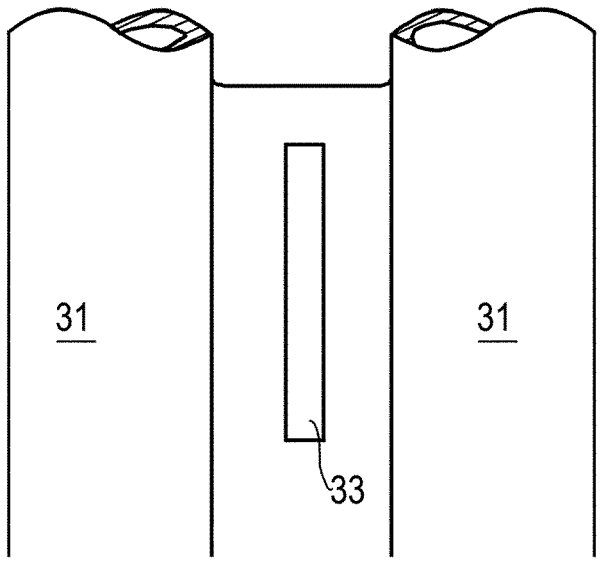
Figure 5C:
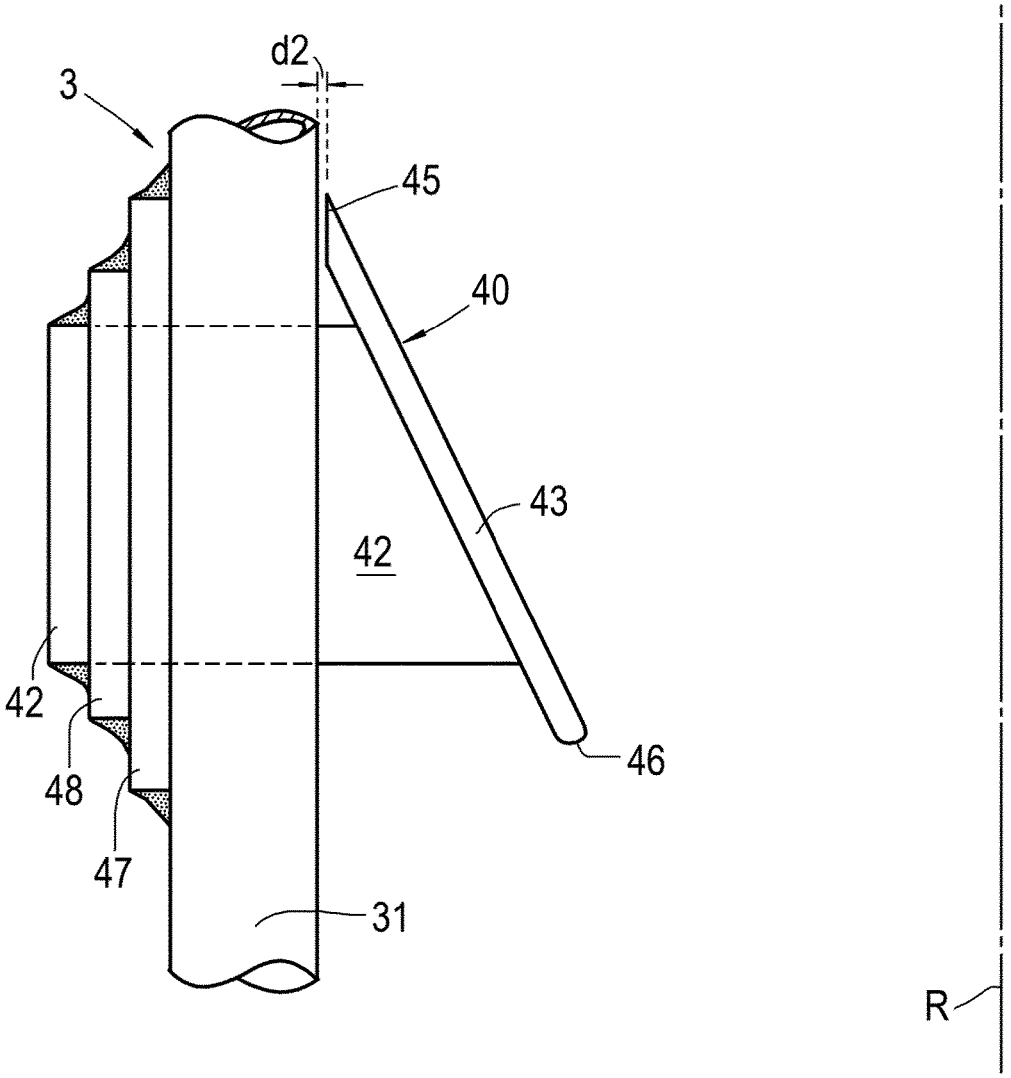

Embodiments will now be described, by way of example only, with reference to the accompanying schematic drawings in which corresponding reference symbols indicate corresponding parts, and in which:

FIG. 1 shows a schematical view of a plant for the production of synthetic gas, FIG. 2 shows a side view of a heat exchange device according to an embodiment, FIG. 3*a* shows a cross sectional top view of part of a membrane wall, FIG. 3*b* shows a cross sectional view of the heat exchange device, FIG. 4*a* shows a cross sectional view of part of the heat exchange device FIG. 4*b* shows a top view of part of the heat exchange device, FIG. 5*a* shows a deflection element, FIG. 5*b* shows part of a membrane wall comprising an opening, and FIG. 5*c* shows a cross-sectional side view of a deflection element and a membrane wall.

DETAILED DESCRIPTION

FIG. 1 schematically shows in cross section a plant for the production of synthetic gas, wherein the plant comprises at least one gasification reactor 101 in which carbonaceous feedstock is partially oxidized producing synthetic gas. The gasification reactor 101 comprises an upwardly inclined discharge section 103 for the produced syngas opening into the top section of a heat exchange unit 104 where the produced syngas is cooled. Cooling or quenching means may be present in the inclined discharge section 103 as well.

The heat exchange unit 104 comprises a closed cylindrical outer wall 2 forming a pressure vessel and encasing a heat exchange device 1. The heat exchange unit 104 further comprises a cylindrical inner channel wall 3, which extends through the heat exchange device 1 and is thus also part of the heat exchange device 1. The heat exchange device 1 is described in more detail with reference to FIG. 2.

It will be understood that FIG. 1 is a schematic representation. Many details are not shown for reasons of clarity, such as burners, supply and discharge lines of oxygen, fuel, slag, cooling fluids, quench device, etc.

FIG. 2 shows the heat exchange device 1 in more detail. The heat exchange device 1 comprises the cylindrical inner channel wall 3, having a central body axis R. The channel wall 3 is formed by parallel vertical cooling liquid conduits interconnected to form a gastight tubular membrane confining a (gas) flow channel 7. A cooling medium, such as water flows through the pipe lines of the channel wall 3.

The discharge section 103 of the gasifier unit opens into an inlet of the flow channel 7. Syngas flows in the direction of arrows A (also see FIG. 1), upwardly from discharge section 103 of the gasifier unit into the heat exchange unit 104 through the flow channel 7 to a lower outlet area.

The channel wall 3 encloses a set of five schematically represented nested coaxial heat exchange surfaces 5*a*, 5*b*, 5*c*, 5*d* and 5*e*. In practice, two or more may be used—for example heat exchange surfaces 5*a* and 5*b*. Like the channel wall 3, the heat exchange surfaces 5*a*-5*e* are built of parallel tubular lines. Optionally, the tubular lines of the heat exchange surfaces 5*a*-*e* can be helically wound.

The heat exchange surfaces 5*a*-5*e* embed one or more flow paths for a fluid heat exchange medium. The heat exchange device 1 therefore comprises one or more coolant supply lines 11 which split via one or more manifolds or distributors 12 into separate coolant supply lines 13 which are in fluid connection with the flow paths embedded in the heat exchange surfaces 5*a*-5*e*. The heat exchange device 1 further comprises separate coolant discharge lines 14 which combine via one or more manifolds or headers 15 into one or more combined coolant discharge lines 16. The arrangement of the supply lines and discharge lines can also be reversed.

A support structure 20 is provided to support the heat exchange surfaces 5*a*-5*e*. The support structure may have any suitable form, such as explained in WO2011/003889. The support structure may comprise three, four or more arms extending from a central crossing which are attached to the channel wall 3.

The support structure and the present of coolant lines make the area above the heat exchange surfaces 5*a*-5*e* difficult to reach for personnel and make it difficult to perform welding operations inside the channel wall 3.

The lower ends of each heat exchange surface 5*b*-5*e* extend past the lower end of the adjacent outer heat exchange surface, respectively. This way, each individual heat exchange surface can be cleaned individually by using rapper devices (not shown).

The channel wall 3 defines a flow channel 7 in which different parallel flow paths are created by the heat exchange surfaces 5*a*-5*e* towards a discharge. The flow path inside the most inner heat exchange surface 5*e* may be closed off by a closing member 17.

FIG. 2 further shows deflection elements 40 positioned inside the flow channel 7 and attached to the channel wall 3 to deflect the gas flow away from the channel wall 3.

FIG. 3*a* schematically shows a cross sectional top view (in the direction of the central body axis R) of part of the channel wall 3, formed by parallel vertical cooling liquid conduits 31 interconnected by fins 32 to form a gastight tubular membrane. In one of the fins an opening 33 is schematically indicated, as will be explained in more detail below.

FIG. 3*b* schematically shows a cross sectional view (in a direction perpendicular to the central body axis R) of part of the heat exchange device 1, showing in more detail the presence of the channel wall 3 comprising conduits 31, the nested heat exchange surfaces 5*a*-5*e* positioned coaxial with respect to the central body axis R and deflection elements 40 positioned upstream of the heat exchange surfaces 5*a*-5*e*, leaving a gap d between the deflection elements and the heat exchange surfaces. Gap d is shown in more detail in FIG. 4*a*.

FIG. 4*a* schematically shows a cross sectional view (in a direction perpendicular to the central body axis R) of a deflection element 40 with respect to the channel wall 3. By way of example FIG. 4*a* shows a conduit 31. The deflection element 40 comprises a deflection surface 41 which deflects the gas flow away from the channel wall 3, as schematically indicated by arrows A'. The deflection surface 41 is at an angle $\beta$ with respect to the channel wall 3 or longitudinal axis R.

FIG. 4*b* schematically shows a top view of part of the heat exchange device 1 showing the channel wall 3 comprising the parallel vertical cooling liquid conduits 31 interconnected by fins 32. Also shown is a deflection element 40 with a deflection surface 41. The deflection surface 41 has an outer edge 45 which matches the shape of the channel wall 3 such that a gas tight sealing is created. The deflection surface 41 further has an inner edge 46 which forms part of circular section which runs coaxial with respect to the channel wall 3. The deflection element 40 extends over an angle $\alpha$ with respect to the central body axis R. The angle being in the range $10° \leq \alpha \leq 45°$, preferably in the range $10° \leq \alpha \leq 30°$.

FIG. 5*a* shows a deflection element 40 comprising a baffle plate 43 and an anchor element 42.

FIG. 5*b* shows part of the channel wall 3, showing two conduits 31 and a fin positioned in between. The fin 32 comprises an opening 33, having dimensions that allow the anchor element 42 to be positioned in the opening 33.

FIG. 5*c* schematically depicts a cross sectional view of the channel wall 3 at the location of a conduit 31 showing deflection element, comprising baffle plate 43 and anchor element 42 extending through the channel wall 3. Further shown are a pad 47 and sealing plate 48. Pad 47 is welded to the channel wall 3 comprising an opening to allow the anchor element 42 to go through. The pad 47 has a shape which matches the outside of the channel wall 3. Sealing plate 48 is welded to pad 47. Sealing plate 48 comprises an opening to allow the anchor element 42 to go through.

FIG. 5*c* schematically shows a gap d2 between the channel wall 3 and outer edge 45 of the deflection element 40 or deflection surface 41. This gap d2, measured in a radial direction perpendicular to the central body axis R is present to overcome difference in thermal expansion between the deflection element 40 or deflection surface 41 and the channel wall 3 and is preferably kept as small as possible to minimize the gas flow through this gap d2. Gap d2 is preferably smaller than 2 mm.

Next, a method of assembly is described in more detail. The method comprises a) providing a channel wall 3 defining a flow channel with an inlet for receiving a gas flow, b) providing one or more heat exchange surfaces 5*a-d* positioned inside the flow channel 3 creating different parallel flow paths for the gas flow through the flow channel, at least one of the heat exchange surfaces 5*a-d* embedding one or more flow paths for a fluid heat exchange medium; and c) installing one or more deflection elements inside the flow channel by attachment to the channel wall to deflect the gas flow away from the channel wall 3.

Action c) comprises inserting the deflection elements 40 from the top of the heat exchange device 1 and slide the anchor element 42 through the opening 33 created in the channel wall. Before or after this, pad 47 is welded to the channel wall 3, such that after inserting the deflection element the anchor element also extends through an opening in the pad 47. Next, sealing plate 48 is welded pad 47 and anchor element 42 is welded against the sealing plate 48 to create a gastight seal.

The deflection elements may be fitted all along the circumference of the channel wall 3 or only along part of the circumference.

As shown in FIGS. 5*a*-5*c*, the opening 33 is such that there is a tightfit between the opening 31 and the anchor element 42. This is to make positioning of the deflection element 40 relatively easy as only the radial position can be varied. However, this allows for limited positioning freedom when positioning a deflection element.

According to an alternative embodiment, the opening 33 is wider and taller than the anchor element 42. The fin 32 may be even cut away completely between adjacent tubes 31 over a predetermined height to create clearance between anchor element 42 and the edges of the opening 33 in the circumferential and vertical/axial direction. Also the dimensions of the opening in the pad 47 are chosen the same as the dimensions of opening 33 or at least larger than the dimensions of the anchor element 42. The dimensions of the opening in the sealing plate 48 are chosen such that a tight fit is created between this opening and the anchor element 42. For instance, the dimensions of the opening in the sealing plate 48 are chosen in the range of 1-2 mm larger than the dimensions of the anchor element 42. This embodiment has the advantage that the deflection element 40 can be aligned in all directions (radial direction, circumferential direction and height direction (parallel to longitudinal axis R)) with respect to the channel wall before it is connected.

Alternatively, instead of pad 47 and sealing plate 48, only one sealing plate is provided, which has an opening chosen such that a tight fit is created between this opening and the anchor element 42.

Descriptions above are intended to be illustrative, not limiting. Thus, it will be apparent to one skilled in the art that modifications may be made to the invention as described without departing from the scope of the claims set out below.

The invention claimed is:

1. A heat exchange device for cooling synthetic gas, the heat exchange device comprising:

a channel wall defining a flow channel with an inlet for receiving a gas flow, wherein the channel wall is a gastight membrane wall comprising a plurality of pipe lines forming one or more flow paths for a cooling medium;

one or more heat exchange surfaces positioned inside the flow channel creating different parallel flow paths for the gas flow through the flow channel, at least one of the heat exchange surfaces embedding one or more flow paths for a fluid heat exchange medium; and one or more deflection elements positioned inside the flow channel and attached to the channel wall to deflect the gas flow away from the channel wall, wherein the one or more deflection elements are positioned upstream of the heat exchange surfaces;

wherein the deflection elements comprise a baffle plate and an anchor element, the baffle plate being connected to the anchor element, the baffle plate being positioned inside the channel wall to deflect the gas flow away from the channel wall and the anchor element extending outwardly from the channel wall through an opening in the channel wall and being attached to the channel wall on the outside of the channel wall.

2. A heat exchange device according to claim 1, wherein the one or more heat exchange surfaces are coaxially nested heat exchange surfaces of a closed geometry.

3. Heat exchange device according claim 1, wherein the deflection elements comprise a deflection surface which is at an angle with respect to the channel wall.

4. Heat exchange device according to claim 1, wherein the individual deflection elements extend over an angle $\alpha$ along the inner perimeter of the channel wall, the angle being in the range $10° \leq \alpha \leq 45°$.

5. Heat exchange device according to claim 1, wherein a gap is present between the baffle plate and the channel wall.

6. Method of assembling a heat exchange device, the method comprising:

a) providing a channel wall defining a flow channel with an inlet for receiving a gas flow, wherein the channel wall is a gastight membrane wall, comprising a plurality of pipe lines forming one or more flow paths for a cooling medium;

b) providing one or more heat exchange surfaces positioned inside the flow channel creating different parallel flow paths for the gas flow through the flow channel, at least one of the heat exchange surfaces embedding one or more flow paths for a fluid heat exchange medium; and c) installing one or more deflection elements inside the flow channel by attachment to the channel wall to deflect the gas flow away from the channel wall, wherein the one or more deflection elements are positioned upstream of the heat exchange surfaces;

wherein the deflection elements comprise a baffle plate and an anchor element, the baffle plate being connected to the anchor element, the baffle plate being positioned inside the channel wall to deflect the gas flow away from the channel wall and the anchor element extending outwardly from the channel wall through an opening in the channel wall and being attached to the channel wall on the outside of the channel wall.

7. Method according to claim 6, wherein c) comprises c1) providing an opening in the channel wall c2) positioning the one or more deflection elements with the baffle plate inside the channel wall and the anchor element protruding through the opening in the channel wall towards the outside of the channel wall, c3) attaching the deflection element on the outside of the channel wall.

8. Method according to claim 6, wherein the method further comprises:

determining the temperature of the fluid heat exchange medium exiting the heat exchange surfaces, adjusting the number, size, position and/or configuration of the deflection elements.

* * * * *